US005664980A

United States Patent [19]

Lin

[11] Patent Number: 5,664,980

[45] Date of Patent: Sep. 9, 1997

[54] COUPLING FOR AN AIR HOSE OF A DIVER'S JACKET

[76] Inventor: Ying-Feng Lin, No. 25, Lane 50, Sec. 3, Chung-Hsiao Rd., Sanchung City, Taipei County, Taiwan

[21] Appl. No.: 611,513

[22] Filed: Mar. 7, 1996

[51] Int. Cl.[6] ..... B63C 9/125

[52] U.S. Cl. ..... 441/92; 405/186; 128/202.14; 251/149.6

[58] Field of Search ..... 441/92; 405/185, 405/186; 251/149.6, 359, 360; 128/202.14

[56] References Cited

U.S. PATENT DOCUMENTS

| | | | |
|---|---|---|---|
| 2,265,267 | 12/1941 | Cowles | 251/149.6 |
| 2,279,146 | 4/1942 | Schneller | 251/149.6 |
| 2,777,716 | 1/1957 | Gray | 251/149.6 |
| 4,000,534 | 1/1977 | Cerniway et al. | 405/186 |
| 4,227,521 | 10/1980 | Hart et al. | 128/202.14 |

*Primary Examiner*—Jesus D. Sotelo
*Attorney, Agent, or Firm*—Morton J. Rosenberg; David I. Klein

[57] ABSTRACT

An improved coupling for an air hose of a diver's jacket includes an outer sleeve with one end fitted onto one end of the air hose, the outer sleeve having an inner tube with multiple annular teeth locked therein, such that the air hose is tightly clamped therebetween. The other end of the outer sleeve is connected to a coupling which has a restriction ring and multiple steel balls provided at one end thereof. The coupling may be speedily connected to a fastening element of the air hose. The coupling accommodates an air intake element one end of which has multiple intake holes circumferentially provided thereon and a groove for receiving an oil ring, the other end of which is a raised stop portion. The air intake element may urge against an inner rim of the coupling by means of the oil ring due to the action of the spring prior to connecting the coupling with the fastening element, so that the inner wall of the coupling and the oil ring may block the intake holes. The fastening element has a pushing portion which may push the air intake element to displace out of the coupling to expose the intake holes to allow air through the air hose when the coupling is connected to the fastening element.

1 Claim, 4 Drawing Sheets

COUPLING FOR AN AIR HOSE OF A DIVER'S JACKET

BACKGROUND OF THE INVENTION (a) Field of the Invention:

The present invention relates generally to a coupling for an air hose of a diver's jacket, and more particularly to an improved coupling which is simple to construct as well as inexpensive and speedy to manufacture. Besides, it ensures a good supply of air to the diver and provides excellent water-proof effects.

(b) Description of the Prior Art:

A conventional coupling for diver's jackets is shown in FIG. 4. It essentially consists of a connecting element 6 having one end thereof provided with an annular toothed portion 66 which has fitted thereon a sleeve 65, which together clamp to an air hose of the diver's jacket. In order to facilitate assembly, the connecting element 6 has the other end thereof provided with a restriction ring 61, multiple steel balls 62 and a stop steel ring 63. The connecting element 6 further accommodates therein an air intake element 7 which in turn accommodates a control rod 71 having a spring 75 fitted thereon. The control rod 71 has one end thereof provided with an air vent cover 72 for sealing the air vents of the air intake element 7. The other end of the air intake element 7 is provided with a raised stop portion 73, while a middle section of the air intake element 7 is configured to have a protrudent press portion 74 for pressing the spring 75. When a fastening element 8 of the air hose is coupled to the connecting element 6, a push portion 81 thereof will push the stop portion 73 and the control rod 71, thereby pushing the air vent cover 72 away from the air vent to permit air into the air hose. Although the above-described arrangement provides sufficient air-tightness, the structure of the air intake element 7 is very complicated and requires relatively higher technique and time to manufacture.

SUMMARY OF THE INVENTION

Accordingly, a primary object of the present invention is to provide an improved coupling for an air hose of a diver's jacket, which, aside from ensuring air-tightness and good supply of air to the air tank, is simple to construct as well as inexpensive and speedy to manufacture.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
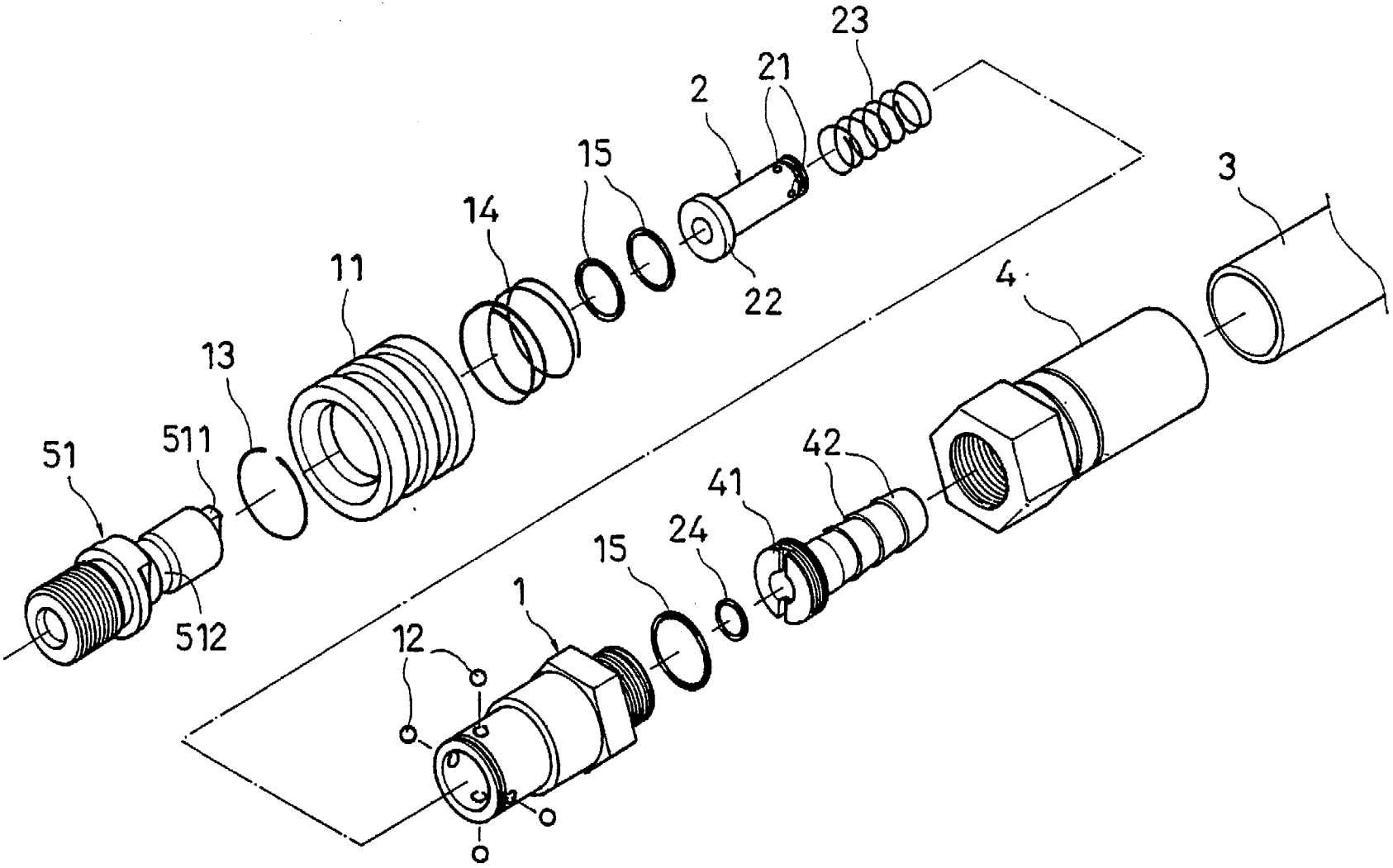
FIG. 1 is an elevational exploded view of the improved coupling structure of the invention.
Figure 2:
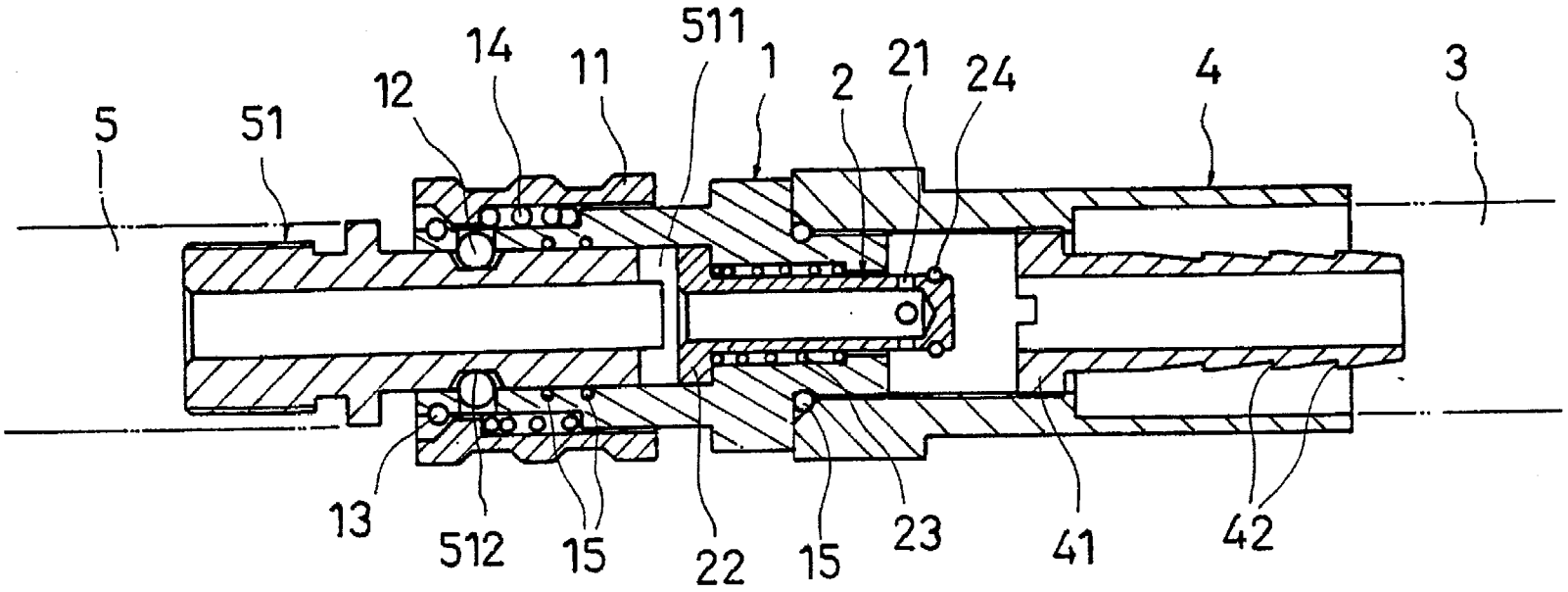
FIG. 2 is a sectional view of the improved coupling of the invention in an assembled state.
Figure 3:
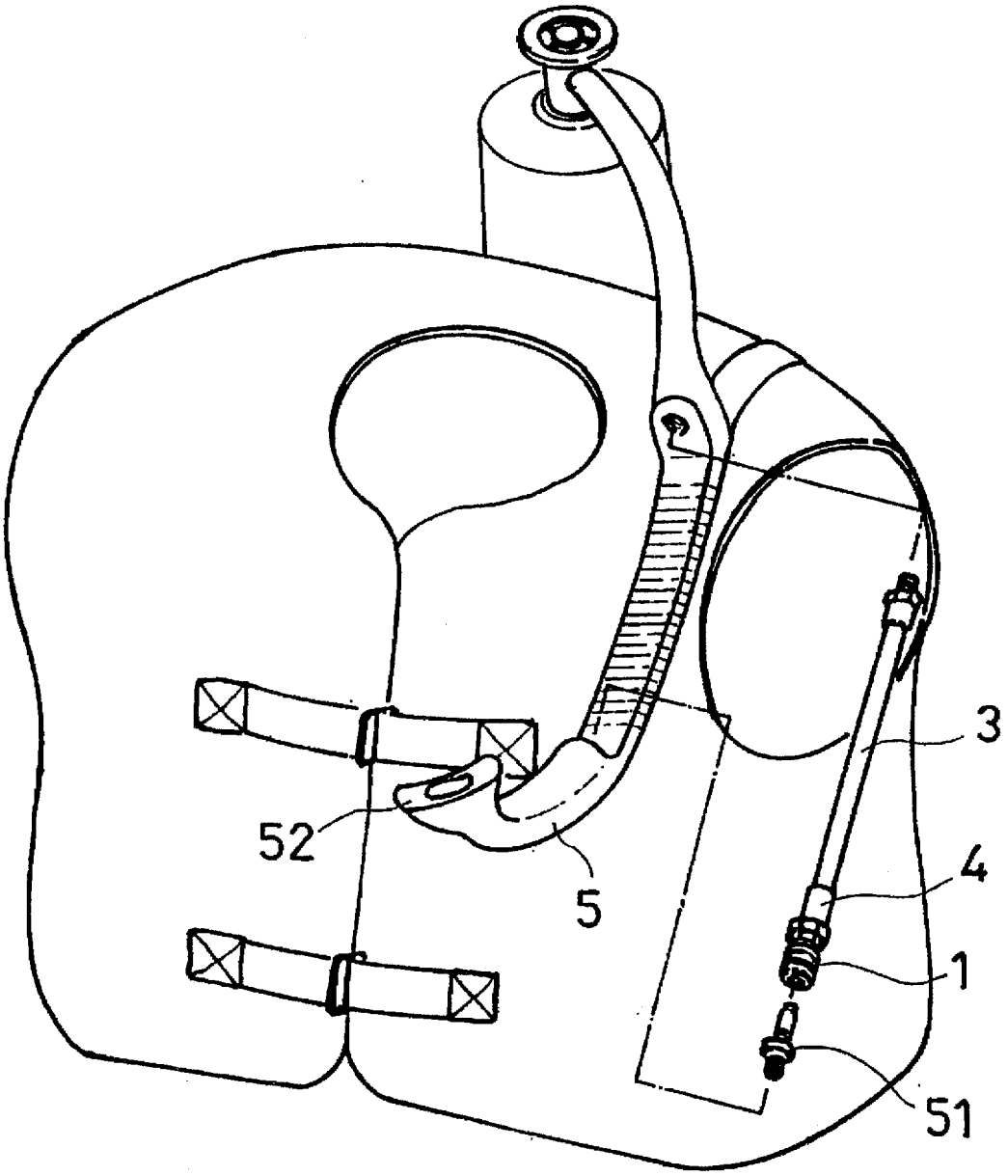
FIG. 3 is an elevational view of the improved coupling of the invention connected to a fastening element of an air hose of a diver's jacket.
Figure 4:
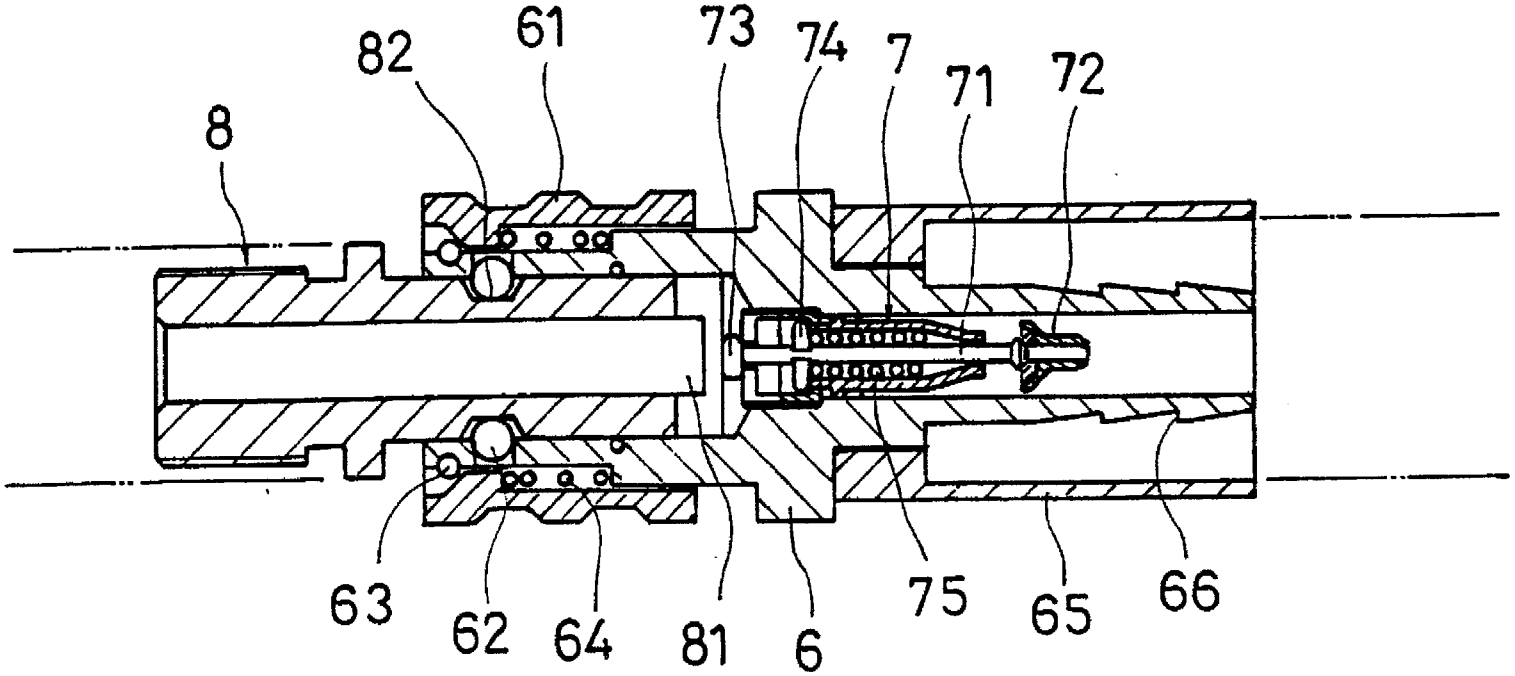
FIG. 4 is a sectional view of a conventional coupling structure.

With reference to FIGS. 1, 2 and 3, an air hose 3 of a diver's jacket has one end thereof fitted with one end of an outer sleeve 4 which has an inner tube 41 with annular teeth

42 lockably secured therein. By means of the outer sleeve 4 and the inner tube 41, the air hose 3 may be tightly clamped. The other end of the outer sleeve 4 is lockably secured to one end of a coupling 1, which has a plurality of movable steel balls 12 respectively accommodated within a plurality of suitably sized holes circumferentially provided thereon. A restriction ring 11 having a plurality of inner annular flanges are fitted onto the coupling 1, with a stop steel ring 13 disposed at an extreme end thereof for confining the restriction ring 11 on the coupling 1. A spring 14 is internally disposed at a rear section of the annular flanges of the restriction ring 11 for urging the restriction ring 11 to abut the stop steel ring 13. The restriction ring 11 may push the steel balls 12 into their respective holes to project from the walls of the inner holes of the coupling 1. A plurality of oil rings 15 are disposed on the coupling at suitable positions to enhance air-tightness after assembly. If it is desirable to speedily join the coupling 1 to a fastening element 51 of an extension arm 5, the restriction ring 11 is pulled backwardly at first so that the steel balls 12 may freely move and displace outwardly so that they no longer project from the walls of the inner holes of the coupling 1, then the fastening element 51 of the extension arm 5 may be squeezed in before releasing the restriction ring 11, which is caused to reset to its original position by the spring 14, pushing the steel balls 12 back in place to project from the walls of the inner holes of the coupling 1 such that the projected portions of the steel balls 12 may be accommodated within a retain slot 512 of the fastening element 51 to firmly fasten the fastening element 51. Furthermore, the coupling 1 internally accommodates an air intake element 2 which has one end portion circumferentially provided with a plurality of intake holes 21 at suitable positions. The end portion of the air intake element 2 is also provided with a groove for receiving an oil ring 24. The air intake element 2 further has a spring 23 fitted thereon and an annular raised stop portion 22 at the other end thereof. Prior to the connection of the coupling 1 and the fastening element 51, the air intake element 2 may be caused to urge against the inner rim of the coupling 1 by means of the oil ring 24 due to the action of the spring 23, and the inner walls of the coupling 1 as well as the oil ring 24 may stop the intake holes 21 to achieve suitable air-tightness. When it is desirable to use the air tank, the fastening element 51 is pushed into the coupling 1 so that a push portion 511 at one end thereof may push the stop portion 22 of the air intake element 2 to cause the air intake element 2 to displace out of the coupling 1 to expose the intake holes 21 to allow air through the air hose 3 into a mouthpiece 52 for the diver's use.

In summary, the present invention provides an improved coupling for air hoses, which is simple and inexpensive to manufacture, convenient to use and repair, without the need to replace the entire air tube in case of damage.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved coupling for an air hose of a diver's jacket, comprising a coupling having one end thereof provided with multiple movable steel balls respectively located in multiple suitably sized holes circumferentially formed round said coupling, a restriction ring fitted onto said coupling, said restriction ring having inner annular flanges, a stop steel ring being disposed at a rear end of said coupling for confining said restriction ring on said coupling, a spring being disposed at a rear section of said annular flanges of said restriction ring for urging said restriction ring against said stop steel ring, said restriction ring being capable of pushing said, steel balls respectively into said holes of said coupling to project from an inner wall of said coupling, a plurality of oil rings being disposed in said coupling at suitable positions to enhance air-tightness, wherein one end of the air hose is fitted with one end of an outer sleeve which has locked therein an inner tube having multiple annular teeth so that the air hose may be held tightly between said outer sleeve and said inner tube, said outer sleeve having the other end thereof lockably connected to said coupling which accommodates an air intake element, said air intake element having one end portion thereof circumferentially provided with multiple intake holes and a groove for receiving a stop oil ring, said air intake element further having a spring fitted thereon and an annular raised stop portion at the other end thereof; said air intake element capable of urging against an inner rim of said coupling by means of said stop oil ring due to the action of said spring prior to connection of said coupling and a fastening element so that the inner wall of said coupling and said stop oil ring stop said intake holes to constitute suitable air-tightness, said fastening element further having a pushing portion capable of pushing said stop portion of said air intake element to cause said air intake element to displace out of said coupling to expose said intake holes to permit air through the air hose into a mouthpiece when said coupling is connected to said fastening element.

* * * * *